US005438785A

United States Patent [19]

Simon

[11] Patent Number: 5,438,785

[45] Date of Patent: Aug. 8, 1995

[54] SYSTEM FOR ASSEMBLING THE BARREL OF A MEDIUM OR LARGE CALIBRE GUN

[75] Inventor: Georges H. Simon, Saint Germain du Puy, France

[73] Assignee: Giat Industries, Versailles, France

[21] Appl. No.: 297,754

[22] Filed: Aug. 30, 1994

[30] Foreign Application Priority Data

Oct. 4, 1993 [FR] France ..... 93 11780

[51] Int. Cl.[6] ..... F41A 21/48

[52] U.S. Cl. ..... 42/75.02

[58] Field of Search ..... 42/75.02, 75.01

[56] References Cited

U.S. PATENT DOCUMENTS

| | | | |
|---|---|---|---|
| 2,736,119 | 2/1956 | Charkson et al. | 42/75.02 |
| 3,611,611 | 10/1971 | Quinney | 42/75.02 |
| 3,849,925 | 11/1974 | Mayer | 42/75.02 |
| 3,877,167 | 4/1975 | Keppeler | 42/75.02 |
| 4,869,153 | 9/1989 | Garcia | 42/75.02 |
| 5,020,260 | 6/1991 | Houghton | 42/75.02 |

FOREIGN PATENT DOCUMENTS

| | | |
|---|---|---|
| 896501 | 2/1945 | France . |
| 2161701 | 6/1973 | France . |

*Primary Examiner*—Charles T. Jordan
*Attorney, Agent, or Firm*—Oliff & Berridge

[57] ABSTRACT

A system for assembling the barrel of a medium or large caliber gun on a sleeve of the gun's breech block assembly includes a nut designed to be screwed on a threaded end of the barrel. The nut is inserted into a cavity inside the sleeve, and a device for driving the nut in rotation is provided. The driving device includes a gear mechanism and a drive system operated from the outside of the sleeve, the drive system being designed to engage the gear mechanism.

15 Claims, 2 Drawing Sheets

SYSTEM FOR ASSEMBLING THE BARREL OF A MEDIUM OR LARGE CALIBRE GUN

BACKGROUND OF THE INVENTION

The present invention concerns a system for assembling the barrel of a medium or large calibre gun to a sleeve on the gun's breech block, the said system being of the type comprising a nut which is screwed on a threaded end of the barrel.

At present barrels are usually attached to the sleeve by means of one of two techniques. In one technique, the barrel is screwed into the breech block by means of matching threads made in the sleeve and on the barrel respectively. In practical terms this technique requires the barrel to be rotated, which is not a simple operation owing to its size and weight. Also, where it is required to obtain a given angular position between barrel and sleeve, the necessary thread starts have to be machined in a highly precise manner, which is also a delicate operation. In a second technique, the barrel is attached to the sleeve by means of a nut at the forward end of the sleeve, the threads in the said nut engaging with a thread on the sleeve. In this case, it is no longer necessary to rotate the barrel, but the presence of the nut at the forward end of the sleeve increases its size. However, the process of screwing the nut is still delicate owing to the tightening torque that has to be applied.

SUMMARY OF THE INVENTION

The main purpose of the invention is to overcome the disadvantages of the first assembly technique mentioned above by perfecting the second assembly technique mentioned above based upon the use of a nut, but the position of the nut and the system used for rotating it are modified to facilitate the assembly operations while limiting the amount of machining that has to be done on the barrel and on the sleeve.

To this end, the invention proposes a system for fitting the barrel of the type mentioned above, and which is characterised in that the nut is fitted freely through an opening in a cavity inside the sleeve to accommodate the said threaded end of the barrel once this is inserted inside the sleeve, and in that the said system also comprises a device for rotating the nut which consists of a gear mechanism and a drive system operated from the outside of the sleeve and which is intended to engage with the gear mechanism.

According to an initial embodiment of the invention, the gear mechanism comprises a pinion which engages straight teeth made on the peripheral surface of the nut.

According to this first embodiment, the pinion is attached to a shaft at least one end of which projects outside the sleeve. The drive system, operated from the outside of the sleeve, consisting of a tool, such as a spanner, designed to engage with the said shaft in order to rotate it.

The pinion in the assembly system can, with advantage, be located entirely outside the sleeve, an opening being made in the said sleeve opposite the cavity containing the nut to allow the pinion to engage with the outer teeth of the nut.

In the case of a gun where the sleeve encloses a chamber of the pivoting type, the nut on the assembly system can, with advantage, be inserted inside the sleeve through one of the lateral openings in the sleeve, these openings being necessary to allow the chamber to pivot.

According to another characteristic of this first embodiment, the pinion of the gear system interlocks with a device for preventing the pinion from rotating in the direction opposite to that corresponding to screwing the nut on the barrel, this device being declutchable to allow the barrel to be removed.

As an example, this locking device consists of a pivoting pawl designed to engage between the teeth of the pinion under the action of a return spring that can be retracted by means of a lever.

In this way, the shaft which rotates the pinion in the gear mechanism is accessible from the forward or rear end of the sleeve, which is an advantage, particularly where a barrel is fitted on a tank turret.

According to a second embodiment of the invention, the gear mechanism comprises a worm which engages with helical teeth on the outer surface of the nut.

According to another characteristic of this second embodiment, the worm is hollow and fitted in a space machined in the thickness of the sleeve, and the drive system operated from the outside of the sleeve consists of a tool such as a spanner which can be partly engaged inside the worm to cause it to rotate, the space containing the worm opening into the cavity containing the nut to allow the worm to engage the nut.

According to another characteristic of this second embodiment, the system also comprises a locking device for preventing the worm from rotating until the drive system is engaged inside the said worm.

In one example of construction, this locking device comprises a plunger housed in the end of the worm and capable of moving axially between two positions, a retractable radial locking pin and a return spring which automatically tends to return the plunger to one of the said positions (the locking position), the radial pin being designed either to engage in a slot in the sleeve to prevent the worm from rotating when the plunger is in its locking position, or to retract into a slot made in the body of the plunger when the plunger is in the other of the said positions so as to allow the worm to rotate.

With a locking device of this kind, the drive system must be engaged in the worm so as to bear on the plunger to release the locking pin and thus allow the worm to rotate.

Another important advantage of the invention is that in general the tightening torque required to screw the nut can be significantly reduced owing to the reduction ratio obtained by the use of a gear mechanism.

BRIEF DESCRIPTION OF THE DRAWINGS

Other characteristic advantages and details of the invention will emerge from the explanatory description below which refers to the attached drawings given solely as examples and wherein.

DESCRIPTION OF PREFERRED EMBODIMENTS

Figure 1:
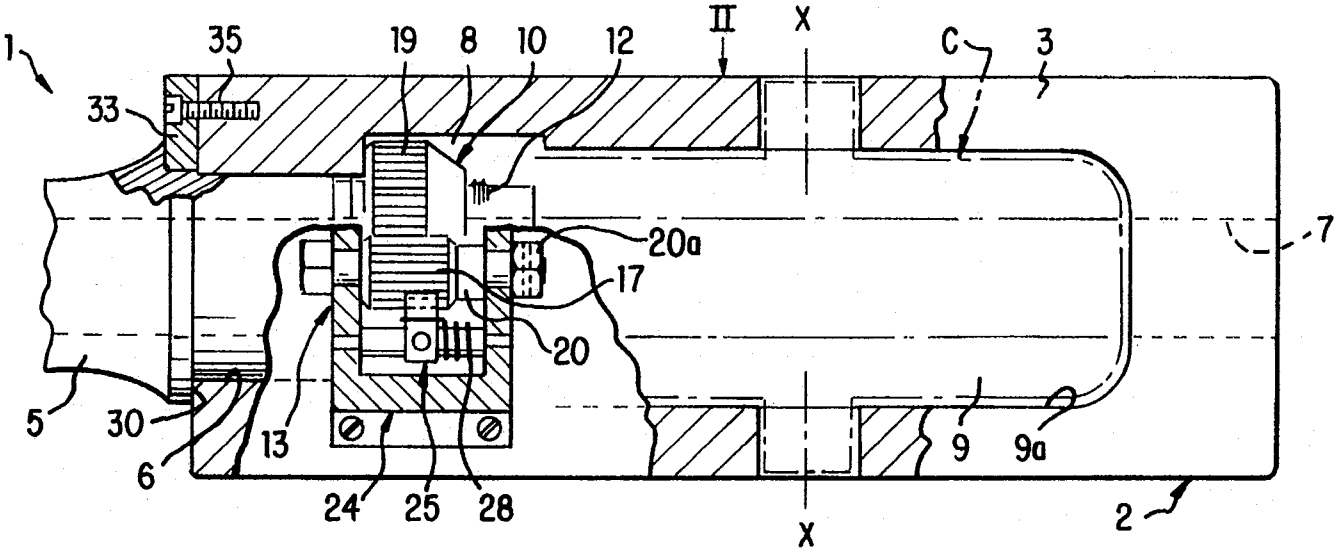
FIG. 1 is a partially separated axial section of one embodiment of the system for fitting a gun barrel according to the invention.

A gun 1 of medium or large calibre comprises in particular a breech block assembly 2 fitted with a sleeve 3 upon which the barrel 5 of the gun is fitted, as shown schematically on FIG. 1.

The sleeve 3 comprises two facing openings at its forward 6 and rear 7 ends respectively. Between these two openings 6 and 7, the space inside the sleeve 3 is subdivided into a forward cavity 8 adjacent to the forward opening 6, and a rear cavity 9 adjacent to the rear opening 7.

A loading chamber C, for example of the pivoting type, is fitted into the rear cavity 9 of the sleeve 3, the pivoting axis X—X of this chamber C being for example perpendicular to the swivel axis of the gun.

The barrel 5 is attached to the sleeve 3 by means of a nut 10 intended to engage with a threaded end 12 of the barrel 5. The nut 10 is mounted freely in the forward cavity 8 of the sleeve 3. The barrel 5 is assembled on the sleeve 3 by rotating the nut 10 on the threaded end 12 of the barrel 5 by means of an assembly system which comprises a gear mechanism 13 and a drive system 15 (FIG. 2) operated from the outside of the sleeve 3 and intended to engage with the gear mechanism 13 to cause the nut 10 to rotate.

Figure 2:
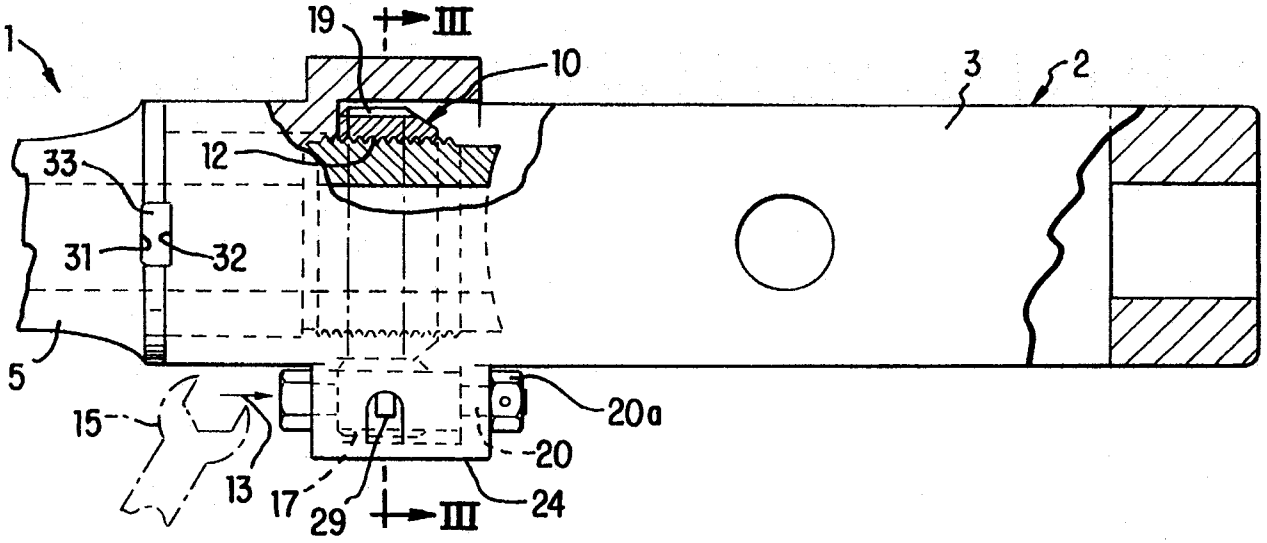
FIG. 2 is a partially separated side view along the arrow II of FIG. 1.
Figure 3:
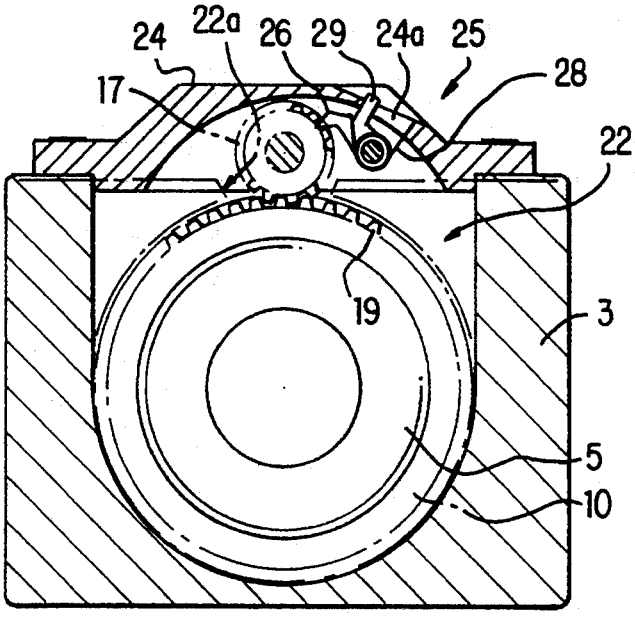
FIG. 3 is a sectional view along the line III—III of FIG. 2.

According to an initial embodiment illustrated on FIGS. 1 to 3, the gear mechanism 13 comprises a pinion 17 which engages with straight teeth 19 cut in the outer surface of the nut 10. The pinion 17 rotates on a shaft 20 which passes through it completely. The shaft 20 has a head **20*a*** of hexagonal shape for example at each end.

In general, the sleeve 3 has a lateral opening 22 through which the nut 10 is inserted into the cavity 8 of the sleeve 3. The pinion 17 penetrates partly through this opening 22 to engage with the teeth 19 on the outside of the nut 10 and in such a way that the shaft 20 attached to the pinion 17 remains outside the sleeve 3 so that it has free access to each end of the shaft. The shaft 20 is supported as it rotates by a housing 24 mounted over the opening 22 of the sleeve 3 and attached to the said sleeve by an appropriate means.

The assembly system is completed by a locking device 25 which interlocks with the pinion 17 in order to prevent the said pinion from rotating in the direction opposite to that corresponding to screwing the nut 10 on the threaded end 12 of the barrel 5, and to prevent the pinion 17 from rotating in the other direction.

The locking device 25 comprises a pawl 26 which fits between the teeth of the pinion 17 under the action of a return spring 28. The pawl 26 can be retracted by means of a lever 29 which projects outside the housing 24 through an opening **24*a***.

The operation of assembling the barrel 5 on the sleeve 3 proceeds as follows.

The nut 10 is mounted free inside the forward cavity 8 of the sleeve 3 through the opening 22, and the rear threaded part 12 of the barrel 5 is inserted through the forward opening 6 of the sleeve 3 in order to centre the nut 10 on the barrel 5. The housing 24 complete with the pinion 17 and the locking device 25 is then inserted into the opening 22 of the sleeve 3, in such a way that the teeth of the pinion 17 engage with the teeth 19 on the outside of the nut 10. Finally, by means of the drive system 15, which is for example a tool such as a spanner placed on the head **20*a* of one end of the shaft 20, the pinion 17 is rotated causing the nut 10 to rotate in its turn and the barrel 5 to be displaced axially. The operation of fitting the barrel 5 terminates when an outer radial shoulder 30 on the barrel 5 comes up against the forward end surface of the sleeve 3, and the nut 10 bears against the end of the forward cavity 8. When these positions are reached, two slots 31 and 32 made in the shoulder 30 of the barrel 5 and the forward surface of the sleeve 3 respectively come opposite one another. A key 33 is then inserted in the space delineated by these two slots 31 and 32 and attached to the sleeve 3 by means of a bolt 35** for example.

Figure 4:
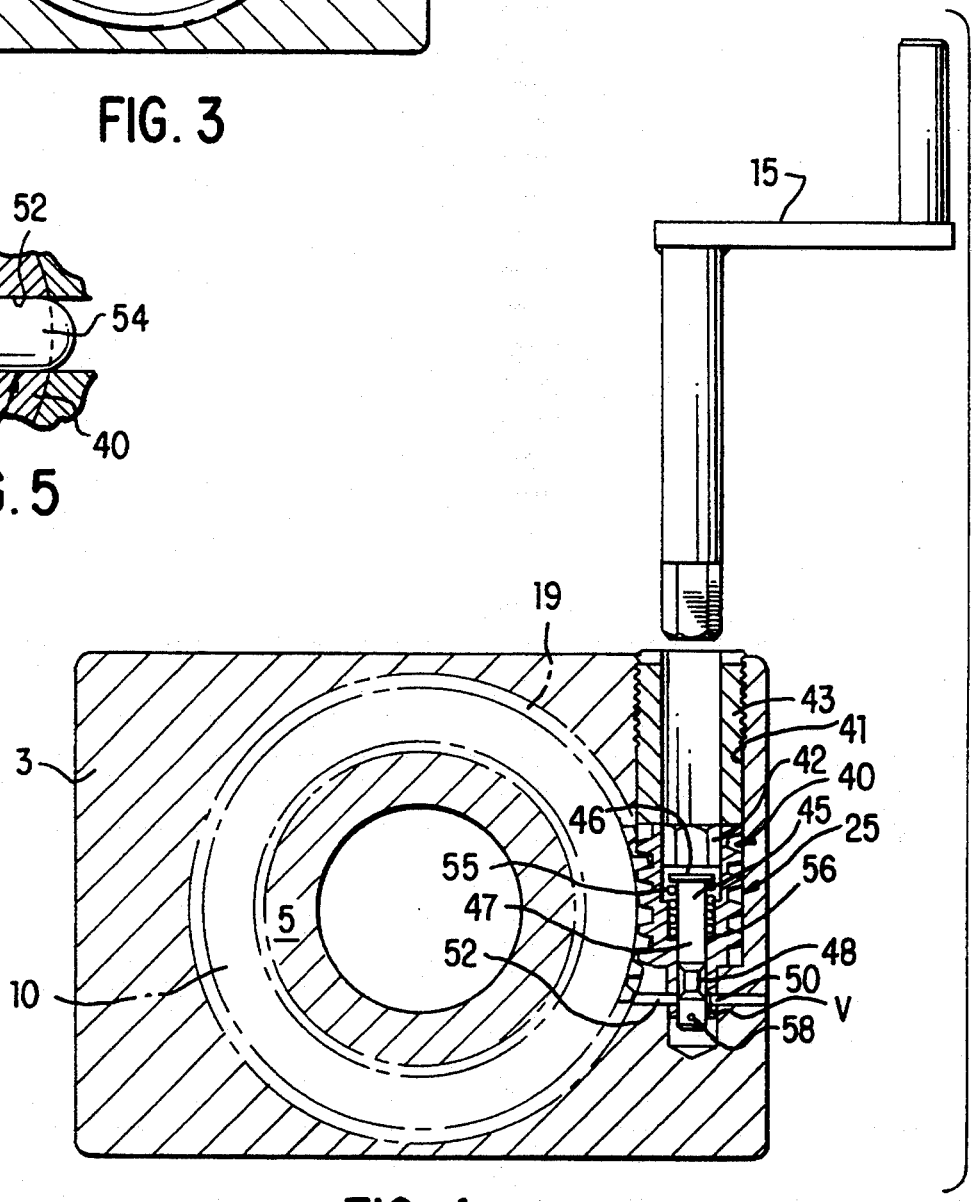
FIG. 4 is a sectional view illustrating a second embodiment of an assembly system according to the invention.

A second embodiment of the invention will be described with reference to FIGS. 4 and 5.

The pinion 17 of the first embodiment is replaced by a worm 40 mounted free in a space 41 machined in the thickness of the sleeve 3. This space 41 extends perpendicularly to the centre line of the sleeve 3 and opens laterally, towards its end, into the forward cavity 8 of the sleeve 3 so that the worm 40 can engage with the teeth 19 on the outside of the nut 10. In this case the teeth 19 are helical.

The worm 40 is hollow to permit the insertion of the drive system 15 consisting of a tool such as a hexagonal spanner for example in order to rotate the worm 40, the profile of the cavity 42 inside the worm 40 matching that of the tool.

The worm 40 is held axially inside the space 41 in the sleeve 3 by a threaded bush 43 which is screwed into the space 41. The inside diameter of the bush 43 is naturally big enough to allow the drive system 15 to pass through.

The assembly system is also completed by a locking device 25 which interlocks with the worm 40 to prevent it from rotating until the drive system 15 has been inserted in the cavity 42 of the worm 40, as will be explained below.

The locking device 25 comprises a plunger 45 fitted in the internal cavity 42 which passes axially entirely through the worm 40. The plunger 45 has at one end a head 46 which is extended by a body 47 having an annular peripheral groove 48 designed to engage with a retractable locking pin 50.

Figure 5:
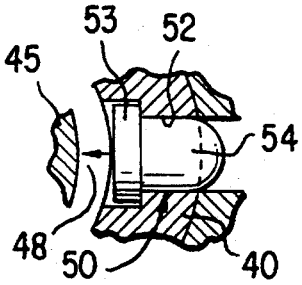
FIG. 5 is an enlarged interior view of the detail indicated by the arrow V on FIG. 4.

With reference to FIG. 5, the locking pin 50 is intended to engage with at least one radial hole 52 which passes through the worm 40 and which is extended into the sleeve 3. The pin 50 has a head 53 extended by a body 54 the free end of which is rounded. The pin 50 is inserted through the inside of the worm 40 so that its body 54 engages in the hole 52 to prevent the worm 40 from rotating with respect to the sleeve 3.

A return spring 55 is fitted around the body 47 of the plunger 45 and the assembly is inserted freely into the internal cavity 42 of the worm 40. The return spring 55 is intended to bear against the head 46 of the plunger 45 and also against an annular shoulder 56 made on the inside of the internal cavity 42 of the worm 40. The plunger 45 is inserted inside the worm 40 until the end of its body 47 projects beyond the end of the cavity 42 which is open to the outside. A pin 58 is then passed through the body 47 of the plunger 45 and bears against the end of the worm 40. Under the action of the return spring 55 the plunger 45 is then in an initial or locking position. In this position, the head 53 of the retractable pin 50 bears against the body 47 of the plunger 45, in other words the groove 48 of the body 47 of the plunger 45 is not opposite the pin 50.

As in the case of the previous embodiment, the nut 10 is fitted freely inside the forward cavity 8 of the sleeve 3, and the rear threaded part 12 of the barrel 5 is inserted through the forward opening 6 of the sleeve 3 in order to centre the nut 10 on the barrel. The drive system 15 is then inserted into the cavity 42 of the worm 40 until it exerts a sufficient pressure on the head 46 of the plunger 45 to move the said plunger into a second position where the pin 50 is opposite the groove 48 in the body 47 of the plunger 45. Then, by forcing the worm 40 to rotate using the drive system 15, the pin 50 can be partly retracted into the groove 48 so as to come free of the sleeve 3 and thus allow the worm 40 to rotate. The rotation of the worm 40 causes the nut 10 to rotate and the barrel 5 to be displaced in an axial direction. On completion of the screwing operation, the drive system 15 is separated from the worm 40. Following this release, the plunger 45 automatically returns to its locking position under the action of the return spring 55. The movement of the plunger 45 forces the pin 50 to come out of the groove 48 and to penetrate further into the hole 52 in the sleeve 3 to prevent the worm 40 from rotating.

In order to remove the barrel 5, it is sufficient once again to insert the drive system inside the worm 40 and to rotate the said worm in the direction opposite to that whereby the nut 10 was screwed onto the threaded part 12 of the barrel 5.

This second embodiment has the particular advantage of eliminating the housing 24 of the first embodiment, in other words the assembly system is entirely contained inside the sleeve 3.

On the example shown in FIG. 1, it was assumed that the sleeve 3 accommodated a chamber C of the pivoting type. In this case, the sleeve 3 has two lateral openings 9*a* opposite one another (FIG. 1) to allow the chamber C to pivot. In these circumstances and according to a variant of the first embodiment of FIGS. 1 to 3, the nut 10 is with advantage inserted into the sleeve 3 through one of the openings 9a. In practice, the lateral opening 22 originally intended for inserting the nut 10 can be reduced to a single hole 22*a* (FIG. 3) just sufficient to allow the pinion 17 to engage with the nut 10. This variant has the particular advantage that there is less reduction in the strength of the sleeve 3.

In general, the field of application of the system according to the invention is not limited to fitting the barrel of a gun, but can be applied to any mechanical system in which a nut or a screw is difficult to access using a conventional drive system.

I claim:

1. An assembly system for attaching a barrel of a gun to a sleeve on a breech block of the gun, comprising:

a nut that is screwed onto a threaded end of the barrel to attach the barrel to the sleeve on the breech block, the nut being inserted into a cavity in the sleeve through an opening in the sleeve;

a gear mechanism that engages the nut and causes the nut to rotate, and a drive system that engages the gear mechanism and causes the gear mechanism to rotate the nut, the drive system being operable from outside the sleeve.

2. Assembly system according to claim 1, wherein the gear mechanism comprises a pinion which engages with straight teeth formed on the outer surface of the nut.

3. Assembly system according to claim 2, wherein the pinion is mounted on a shaft, at least one end of the shaft projecting outside the sleeve, and the drive system comprises a tool designed to engage with the shaft to cause the pinion to rotate.

4. Assembly system according to claim 3, wherein substantially all of the pinion is located outside the sleeve, the pinion engaging with the teeth of the nut through a hole in the sleeve which opens into the cavity containing the nut.

5. Assembly system according to claim 3, wherein the tool comprises a wrench.

6. Assembly system according to claim 3, further comprising a locking device which in a locked position prevents the pinion from rotating in a direction opposite to the direction that causes the nut to be screwed onto the barrel and in an unlocked position allows the nut to be screwed off the barrel to allow the barrel to be removed.

7. Assembly system according to claim 6, wherein the locking device comprises:

a pawl that engages the pinion to prevent the pinion from rotating in a direction opposite to the direction that causes the nut to be screwed onto the barrel, the pawl having a lever that is operable from outside the sleeve to disengage the pawl from the pinion to declutch the locking device; and a spring for urging the pawl to engage the pinion.

8. Assembly system according to claim 1, wherein the gear mechanism comprises a worm which engages helical teeth formed on the outer surface of the nut, the worm being fitted into a space machined in the thickness of the sleeve, the space opening into the cavity containing the nut.

9. Assembly system according to claim 8, further comprising a locking device which in a locked position prevents the worm from rotating in a direction opposite to the direction that causes the nut to be screwed onto the barrel and in an unlocked position allows the nut to be screwed off the barrel.

10. Assembly system according to claim 8, the worm is hollow and the drive system operated from outside the sleeve comprises a tool which is inserted inside the worm, the tool being operable to cause the worm to rotate.

11. Assembly system according to claim 10, wherein the tool comprises a wrench.

12. Assembly system according to claim 10, further comprising a locking device to prevent the worm from rotating unless the tool of the drive system is inserted in the worm.

13. Assembly system according to claim 12, wherein the locking device comprises a plunger housed inside the worm and capable of being moved axially between a locked position and an unlocked position, a retractable locking pin, and a return spring which biases the plunger toward its locked position, the retractable locking pin being designed either to engage in a hole of the sleeve to prevent the worm from rotating when the plunger is in its locked position, or to be retracted inside a groove in the body of the plunger when the plunger is in its unlocked position so that the worm can rotate.

14. Assembly system according to claim 13, wherein the tool of the drive system is inserted inside the worm in order to move the plunger from its locked position to its unlocked position, the plunger returning automatically to its locked position under the action of the return spring when the tool of the drive system is removed from the worm.

15. Assembly system according to claim 13, wherein said sleeve includes a hole which the locking pin engages to prevent the worm from rotating when the tool is not inserted in the worm.

* * * * *